US006113508A

United States Patent [19]

Locarno et al.

[11] Patent Number: 6,113,508

[45] Date of Patent: Sep. 5, 2000

[54] ADJUSTING STIFFNESS AND FLEXIBILITY IN SPORTS EQUIPMENT

[75] Inventors: Michael Locarno, Kinnellon, N.J.; Guy Wheeler, Redding, Conn.; Robert Walsh, Matawan, N.J.; William C. Doble, Essex Junction, Vt.

[73] Assignee: Alliance Design and Development Group, Keyport, N.J.

[21] Appl. No.: 09/136,117

[22] Filed: Aug. 18, 1998

[51] Int. Cl.[7] ..... A63B 53/00; A63B 59/12

[52] U.S. Cl. ..... 473/516; 473/524; 473/564; 473/560; 473/318

[58] Field of Search ..... 473/516, 524, 473/558, 559, 560, 564, 318, 323; 280/601, 602, 610

[56] References Cited

U.S. PATENT DOCUMENTS

| | | | |
|---|---|---|---|
| Re. 31,419 | 10/1983 | Frolow . | |
| 1,662,712 | 3/1928 | Mensing | 473/318 |
| 1,994,069 | 3/1935 | Fletcher | 473/323 X |
| 3,300,226 | 1/1967 | Reed, Jr. . | |
| 3,461,593 | 8/1969 | Martuch et al. . | |
| 3,612,121 | 10/1971 | Estwing . | |
| 3,833,219 | 9/1974 | Dean . | |
| 3,833,223 | 9/1974 | Shulkin . | |
| 3,913,918 | 10/1975 | Trachtman . | |
| 3,940,134 | 2/1976 | Bieganowski . | |
| 4,024,666 | 5/1977 | Carver . | |
| 4,082,273 | 4/1978 | Ellzey . | |
| 4,105,205 | 8/1978 | Theodores et al. . | |
| 4,159,114 | 6/1979 | Ardell et al. . | |
| 4,214,395 | 7/1980 | Caldwell, Jr. | 473/318 X |
| 4,221,400 | 9/1980 | Powers . | |
| 4,351,528 | 9/1982 | Duplin | 473/560 |
| 4,358,113 | 11/1982 | McKinnon et al. . | |
| 4,577,886 | 3/1986 | Chernega . | |
| 4,685,682 | 8/1987 | Isabell . | |
| 4,738,046 | 4/1988 | Fraylick et al. . | |
| 4,854,596 | 8/1989 | Carbonetti . | |
| 5,108,114 | 4/1992 | Marx . | |
| 5,244,442 | 9/1993 | Schill . | |
| 5,393,085 | 2/1995 | Forneri | 280/602 |
| 5,409,216 | 4/1995 | Brown . | |
| 5,454,562 | 10/1995 | Sommer . | |
| 5,456,650 | 10/1995 | Williams, Jr. et al. . | |
| 5,520,386 | 5/1996 | Sasko . | |
| 5,641,162 | 6/1997 | Brown . | |
| 5,653,643 | 8/1997 | Falone et al. | 473/318 X |
| 5,879,250 | 3/1999 | Tahtinen et al. . | |
| 5,913,733 | 6/1999 | Bamber | 473/318 X |

*Primary Examiner*—Raleigh W. Chiu
*Attorney, Agent, or Firm*—Cobrin & Gittes

[57] ABSTRACT

A sports apparatus with variable directions of stiffness and flexibility, including sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis.

35 Claims, 12 Drawing Sheets

ADJUSTING STIFFNESS AND FLEXIBILITY IN SPORTS EQUIPMENT

BACKGROUND OF THE INVENTION

1. Field of the Invention

The invention relates to a sports apparatus whose degree and direction of stiffness and flexibility may be varied.

2. Discussion of Related Art

In recent years, sports equipment manufacturers have increasingly turned to different kinds of materials to enhance their sporting equipment. In so doing, entire lines of sports equipment have been developed whose stiffness or flexibility characteristics are but a shade different from each other. Such a shade of difference, however, may be enough to give the sports equipment user an edge over the competition or enhance sports performance.

With such a selection and variety of sports equipment available, the sports equipment user may train with equipment with different stiffness or flexibility characteristics as desired and, during play, may switch to sports equipment that is slightly more flexible or stiffer to suit changing playing conditions or to help compensate for weariness or fatigue.

Nevertheless, there are limitations. Subtle changes in the stiffness or flexibility characteristics of sports equipment may not be available between different pieces of sports equipment. This is due to the characteristics being fixed by the manufacturer because of the choice of materials, design, etc.

A sports player desiring to change the lift in a sports object being struck with a striking surface of sports equipment may prefer a more flexible or stiffer characteristic.

Turning to various types of sports, it can be seen how the lack of adjustability in stiffness and flexibility may adversely affect optimum performance of the player.

HOCKEY

Hockey includes, but is not limited to, ice hockey, street hockey, roller hockey, field hockey and floor hockey.

Hockey players may require that the flexure of the hockey stick be changed to better assist in the wrist shot or slap shot needed at that particular junction of a game or which the player was better at making. Younger players may require more flex in the hockey stick due to lack of strength; such flex may mean the difference between the younger player being able to lift the puck or not when making a shot since a stiffer flex in the stick may not allow the player to achieve such lift.

In addition, as the younger players ages and increases in strength, the player may desire a stiffer hockey stick, which in accordance with convention means the hockey player would need to purchase additional hockey stick shafts with the desired stiffness and flexibility characteristics. Indeed, to cover a full range of nuances of differing stiffness and flexibility characteristics, hockey players would have available many different types of hockey sticks.

Even so, the hockey player may merely want to make a slight adjustment to the stiffness or flexibility of a given hockey stick to improve the nuances of the play. Such would not be possible unless the multitude of hockey sticks included those having all such slight variations in stiffness and flexibility needed to facility such nuances.

TENNIS

Tennis players also may want some adjustability in their tennis rackets. Tennis rackets include those which allow the handle to rotate relative to the racket shaft, such as disclosed in U.S. Pat. No. 5,409,216 (hereinafter the '216 patent), to improving the grip on the handle while performing various tennis shots. In the case where the shaft is in the form of double head ends as also shown in the '216 patent, the result may be a change in the stiffness or flexibility of the racket due to a change in orientation of the double head ends relative to the racket head.

Although tennis players may be comfortable with the grip afforded by such a handle, they may desire a stiffer or more flexible racket, particularly so as the tennis player becomes more weary during play. Such would not be possible without sacrificing the comfortable grip, unless the tennis player were equipped with a multitude of tennis rackets to choose from, each varying slightly as concerns stiffness and flexibility.

LACROSSE

Lacrosse players use their lacrosse sticks to scoop up a lacrosse ball and pass the ball to other players or toward goal. The stiffness or flexibility of the lacrosse stick may affect performance during the game. Players may tire so some adjustment to the flexibility of the stick may be desired to compensate. With conventional lacrosse sticks, such adjustment is not available.

OTHER RACKET SPORTS

Other types of racket sports also suffer from the drawback of being unable to vary the stiffness and flexibility of the racket during the course of play to suit the needs of the player at that time, whether those needs arise from weariness, desired field positions, or training for improvement. Such racket sports include racquetball, paddleball, squash, badminton, and court tennis.

For conventional rackets, the stiffness and flexibility is set by the manufacturer and invariable. If the player tires of such characteristics being fixed or otherwise wants to vary the stiffness and flexibility, the only practical recourse is to switch to a different racket whose stiffness and flexibility characteristics better suit the needs of the player at that time.

GOLF

Golf clubs may be formed of graphite, wood, titanium, glass fiber or various types of composites or metal alloys. Each varies to some degree with respect to stiffness and flexibility. However, golfers generally carry onto the golf course only a predetermined number of golf clubs for driving. Varying the stiffness or flexibility of the golf club is not possible, unless the golfer brings another set of clubs of a different construction. Even in that case, however, the selection is still somewhat limited.

Nevertheless, it is impractical to carry a huge number of golf clubs onto the course, each club having a slight nuance of difference in flexibility and stiffness than another. Golf players prefer taking onto the course a set of clubs that are suited to the player's specific swing type, strength and ability.

SKIING

Skis are made from a multitude of different types of materials and dimensions, the strength and flexibility of each type differing to a certain extent. Skis include those for downhill ice skiing, cross-country skiing and water-skiing. Other types of snow sports devices include snowboards, snow skates and skiboards. Beginners generally require more flex and, as they progress in ability, much less.

Skiers generally do not carry with them a multitude of different types of skis for themselves use during the course of the day to suit changing skiing conditions or to compensate for their own weariness during the day. The same holds true for those who use snowboards, snow skates and skiboards.

BATTING

Sports such as baseball, softball, and cricket use bats to strike a ball. The batter may want to select a bat that is more stiff or flexible, depending upon the circumstances of play. Conventional bats only permit the batter to choose from among a variety of bats of different weights and materials to obtain the desired stiffness or flexibility. However, adjusting the stiffness or flexibility characteristics for a given bat is not feasible conventionally. Further, there is no practical way conventionally to determine which batting flexure and stiffness is optimal for batters with a single batting device.

POLO

Polo players use mallets during the course of the polo match. Changing the stiffness or flexibility characteristics is only available by exchanging for a different mallet with the desired characteristics.

SAILBOATING and SAILBOARDING

Masts of sailboats and sailboards support sails, which are subjected to wind forces. These wind forces, therefore, act through the sails on the mast. The mast may be either a rigid or flexible structure, which may be more desirable under certain sailing conditions. If the mast is flexible, tension wires may be used to vary the tension of the mast. Otherwise, the flexibility and stiffness characteristics of mast are generally fixed by the manufacturer, making it impractical to alter the mast flexibility or stiffness in different directions to suit changes in wind direction or the needs of the sailor.

CANOEING, ROWBOATING and KAYAKING

Paddles for canoes, row boats, and kayaks are subjected to forces as they are stroked through water. The flexibility or stiffness of the paddles, while different depending upon its design and materials, is fixed by the manufacturer. Thus, a rower who desired to change such characteristics would need to switch to a different type of paddle. Carrying a multitude of different types of paddles for use with a canoe, row boat or kayak, however, is generally impractical for the typical rower from the standpoint of cost, bulk and storage.

POLE VAULTING

Pole vaulters use a pole to lift themselves to desired heights. The pole has flexibility and stiffness characteristics to assist in attaining this goal. Varying those characteristics, however, requires switching to a different pole, because such characteristics are generally fixed by the manufacturer.

As defined in this application, sports equipment covers any type of stick, bat, racket, club, ski, board, mast, pole, skate, paddle or mallet that is used in sports, except for fishing rods. Fishing rods are unique in that they are flexed for casting out a line; none of the other types of equipment mentioned in this application for sports equipment is used to cast out a line or the like. Instead, they flex to strike or pick up and carry an object such as a ball or puck (hockey, lacrosse, batting, golf, tennis, etc.) or to carry a person (pole vaulting), flex in response to engaging a frictional surface such as skis against the ground, snow or water, or flex in response to environmental forces such as the wind against a sail.

SUMMARY OF THE INVENTION

One aspect of the invention resides in a sports apparatus with variations in stiffness and flexibility, comprising sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis.

Another aspect of the invention resides in a sports apparatus with variations in stiffness and flexibility, comprising sports equipment having an elongated cavity with a longitudinal axis extending in a direction of elongation of the cavity; and means imparting stiffness and flexibility variations within the cavity so the sports equipment becomes more stiff in one direction than in a different direction and is more flexible in the different direction than in the one direction, both the one direction and the different direction being directed transverse to the longitudinal axis.

A further aspect of the invention resides in a method of varying stiffness and flexibility, comprising providing sports equipment having an elongated cavity with a longitudinal axis extending in a direction of elongation of the cavity; and imparting stiffness and flexibility variations within the cavity so the sports equipment becomes more stiff in one direction than in a different direction and is more flexible in the different direction than in the one direction, both the one direction and the different direction being directed transverse to the longitudinal axis.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
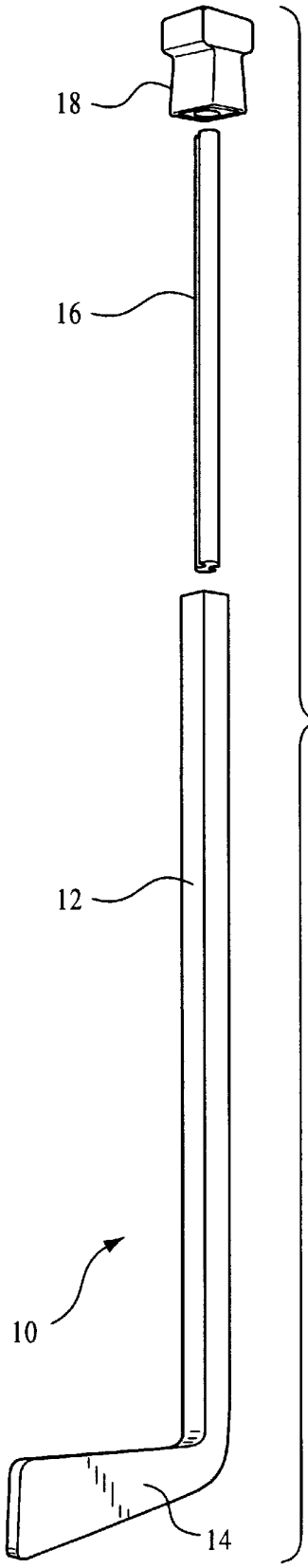
FIG. 1 is an exploded view in perspective of the present invention.

Turning to the drawings, FIG. 1 shows a hockey stick 10, which has a body that includes a shaft 12 and blade 14. Also shown is a stiffening rod 16' and a cap 18. For ease of illustration, the top of the hockey stick 10 is not shown in FIG. 1, but it may appear as shown in FIGS. 2 or 3, depending upon the embodiment.

Figure 2:
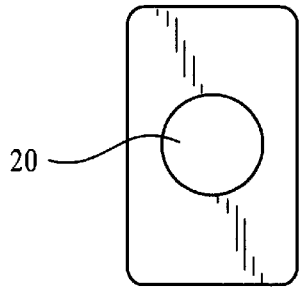
FIG. 2 is a top view of the hockey stick shaft of FIG. 1 in accordance with a first embodiment.

In the case of FIG. 2, the hockey stick 10 is made entirely of wood and, to accommodate insertion of the stiffening rod 16, a cavity 20 is bored through a majority of the length of the hockey stick shaft 12 and just enough such that after the stiffening rod 16 is inserted as far as possible into the cavity 20, a relatively small portion protrudes out of the cavity.

Figure 3:
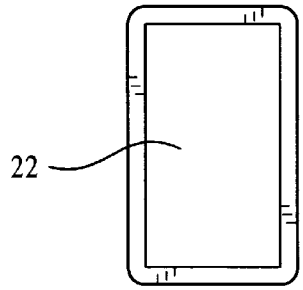
FIG. 3 is a top view of the hockey stick shaft of FIG. 1 is accordance with a second embodiment.
Figure 4:
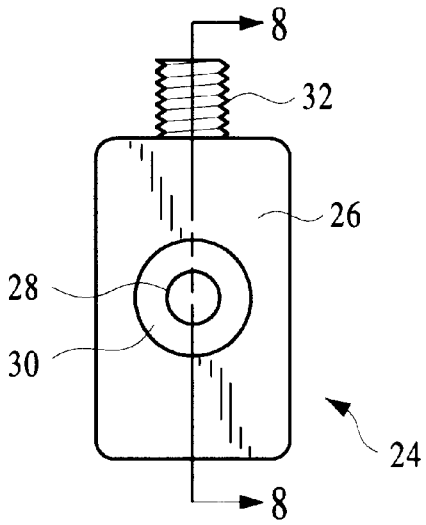
FIG. 4 is a bottom view of a stiffening rod holder.
Figure 5:
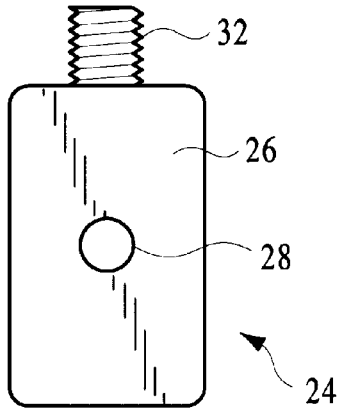
FIG. 5 is a top view thereof.
Figure 6:
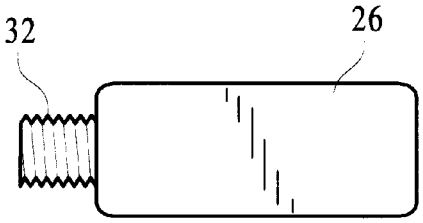
FIG. 6 is a right side thereof which is symmetric to the left side thereof.
Figure 7:
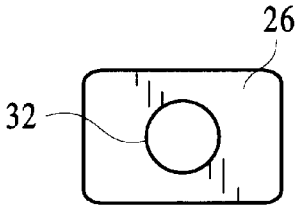
FIG. 7 is a front view thereof, the rear side being plain.
Figure 8:
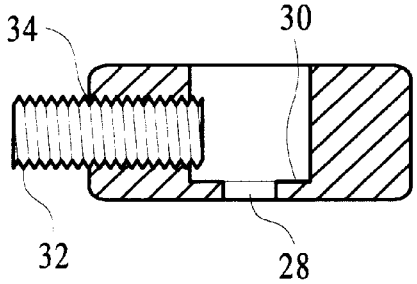
FIG. 8 is a cross-section across lines 8—8 of FIG. 4.

In the case of FIG. 3, the hockey stick 10 is made entirely of plastic with an inner cavity 22 that extends a majority of the length of the hockey stick shaft 12.

FIGS. 4–8 show a holder 24 within the cap 18 of FIG. 1. The holder may be metallic and includes a body 26, a through-going hole 28, a recess 30, a fastener screw 32, and a threaded opening 34 in which is threaded the fastener screw 32. A portion of the stiffening rod 16 protrudes out of the cavity 22 and fits into the recess 30. The fastener screw 32 is tightened to secure the holder onto the protruding portion of the stiffening rod 16.

Once so secure, twisting the holder 24 about the longitudinal axis of the stiffening rod 16 may be effected with additional leverage exerted at the holder 24 to position the stiffening rod 16 into a desired relative orientation. The fastener screw 32 may serve as an indication of the relative position of the stiffening rod 16 to the shaft 12 since both the holder 24 and the stiffening rod 16 will turn together.

Figure 9:
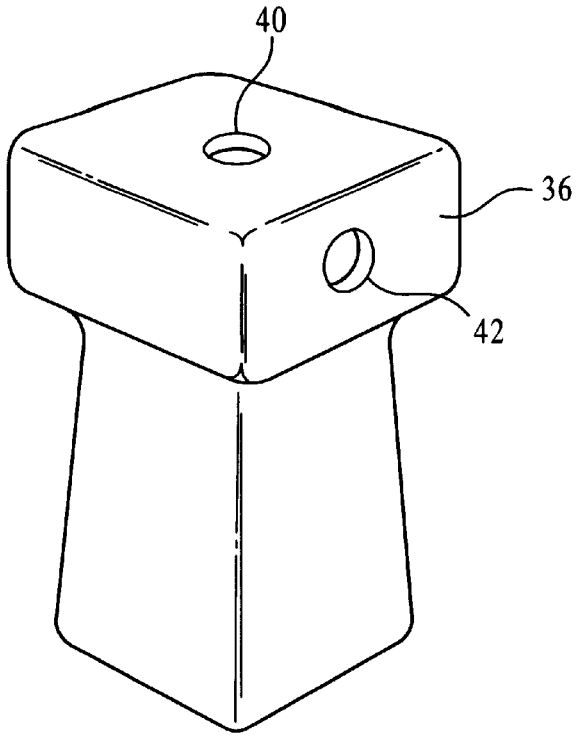
FIG. 9 is a perspective view of a handle cap.
Figure 10:
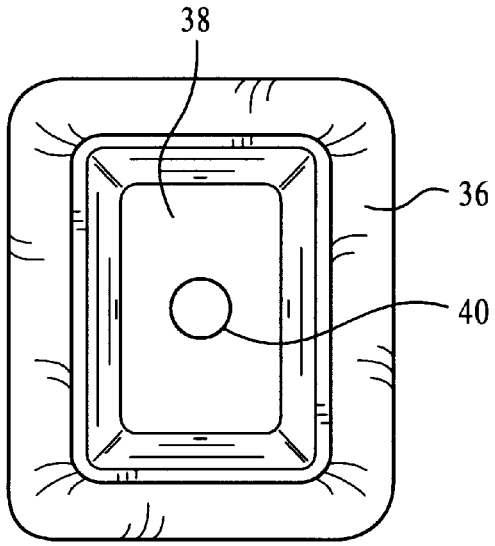
FIG. 10 is a bottom view thereof.

The holder 24 fits within the rubber sheath 36 (see FIGS. 9–10) of the cap 18 (see FIG. 1). Turning to FIGS. 9–10, the sheath 34 includes a recessed base 38, against which is fitted the holder 24. This base 38 has a central opening 40 in alignment with the through-going hole 28 of the holder 24. One of the sidewalls of the sheath 36 has an opening 42 in alignment with the threaded opening 34 and through which extends the fastener screw 32. The sheath 36 is made of an elastic material such as rubber and stretches over the free end of the hockey stick shaft 12. Resilient forces keep the sheath 36 in position on the shaft 12.

A designation may be placed on the shaft neighboring its upper end to signify a reference location. Turning to FIG. 1, markings may be spaced about the periphery at the top of the stiffening rod 16, each representing different graduation in stiffness or flexibility. When the stiffening rod 16 is fully inserted within the cavity of the shaft 12, it still has a portion protruding out of the cavity. This protruding portion may have the markings signifying the different degrees of stiffness or flexibility.

Whichever of the markings aligns with the reference location designation on the shaft should be indicative of the stiffness or flexibility associated with the marking. Thus, the reference location designation should be located so when aligned with the marking on the stiffening rod signifying the most stiff or most flexible, the stiffening rod orientation coincides with that needed to impart the most stiff or most flexible characteristic to the shaft out of all the settings.

Turning to FIG. 1, the stiffening rod 16 has a I-shape 50, with the outer facing ends curved convex. Other embodiments of the stiffening rod are shown in FIGS. 11–14.

Figure 11:
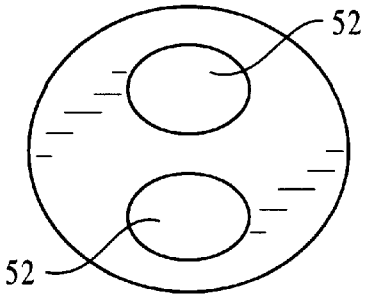
FIGS. 11–14 are bottom views of stiffening rods in accordance with further embodiments.
Figure 12:
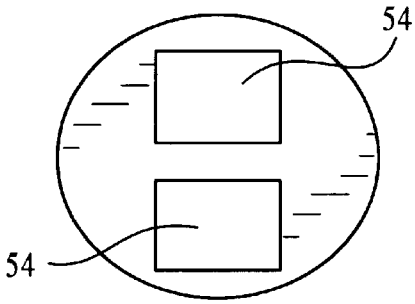
Figure 13:
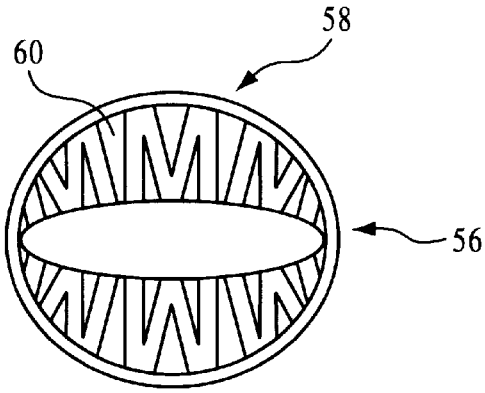

FIG. 11 shows the stiffening rod to be round, but with two spaced apart oval gaps 52. FIG. 12 is similar to FIG. 11, except that the oval gaps are replaced by rectangular gaps 54. FIG. 13 shows an oval central region 56 with M-shaped spikes 58 extending radially from the oval central region 56. Between neighboring spikes are gaps 60. In each of the embodiments of FIGS. 11–13, the gaps 52, 54, 60 may extend the full length of the stiffening rod.

Figure 14:
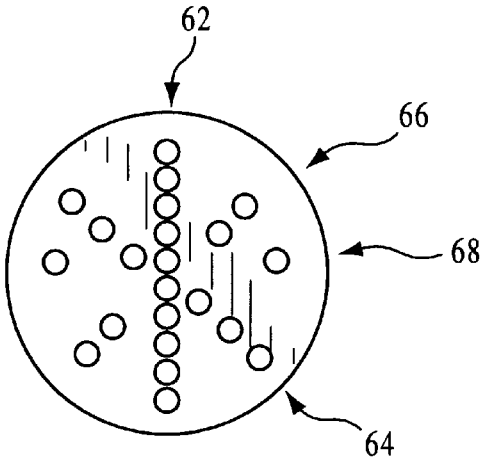
Figure 15:
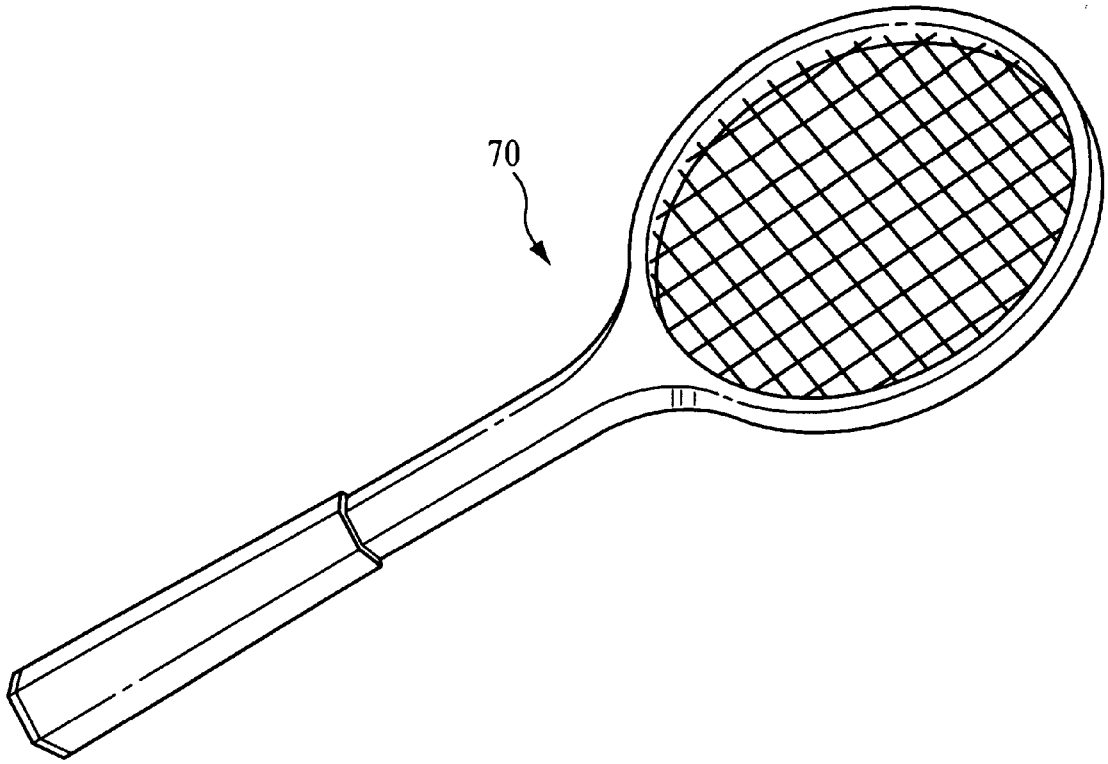
FIG. 15 is a longitudinal view of a racket with a stiffening rod in accordance with an additional embodiment of the present invention.

FIG. 14 shows a stiffening rod 16 configured with four series of aligned holes, 62, 64, 66, 68 (i.e., 10 holes, 6 holes, 4 holes, 2 holes). Each of the holes may extend the full length of the stiffening rod 16. The four series, however, are out of alignment with respect to each other and the number of holes in each differ. In the case of FIG. 14, the holes are of uniform size, but the holes may differ in dimension if desired.

The stiffening rods 16 of FIGS. 1, 11 and 12 each offer greater stiffness in one direction and greater flexibility in the other. The stiffening rod 16 of FIG. 13 offers the same, except it also permits indexing the varying degrees of stiffness due to the cam shape. There is less friction between the stiffening rod 16 and hockey stick shaft for easier turning within the shaft over that of the embodiments of FIGS. 1, 11 and 12. In addition, rattling is avoided. The FIG. 14 embodiment offers variable stiffness within the shaft upon turning of the stiffening rod 16 clockwise or counterclockwise.

What is common to each of these embodiments is the concept of the stiffening rod 16 being configured with stiffness and flexibility characteristics that vary in a non-uniform manner from the longitudinal axis of the rod outwardly in directions transverse to a direction of elongation of the stiffening rod 16. Also, the configurations are each symmetric about a horizontal center line.

In accordance with the invention, therefore, a hockey player now has the freedom adjust the stiffness or flexibility setting to suit the desired play for striking the puck with the blade of the hockey stick, i.e., for passing the puck or hitting the puck towards goal.

Figure 16:
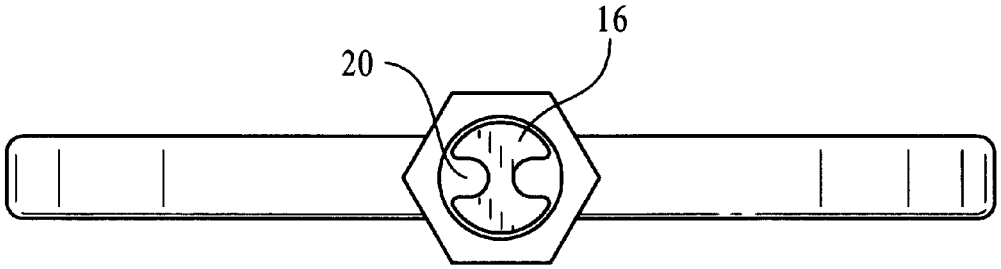
FIG. 16 is an end view thereof.
Figure 17:
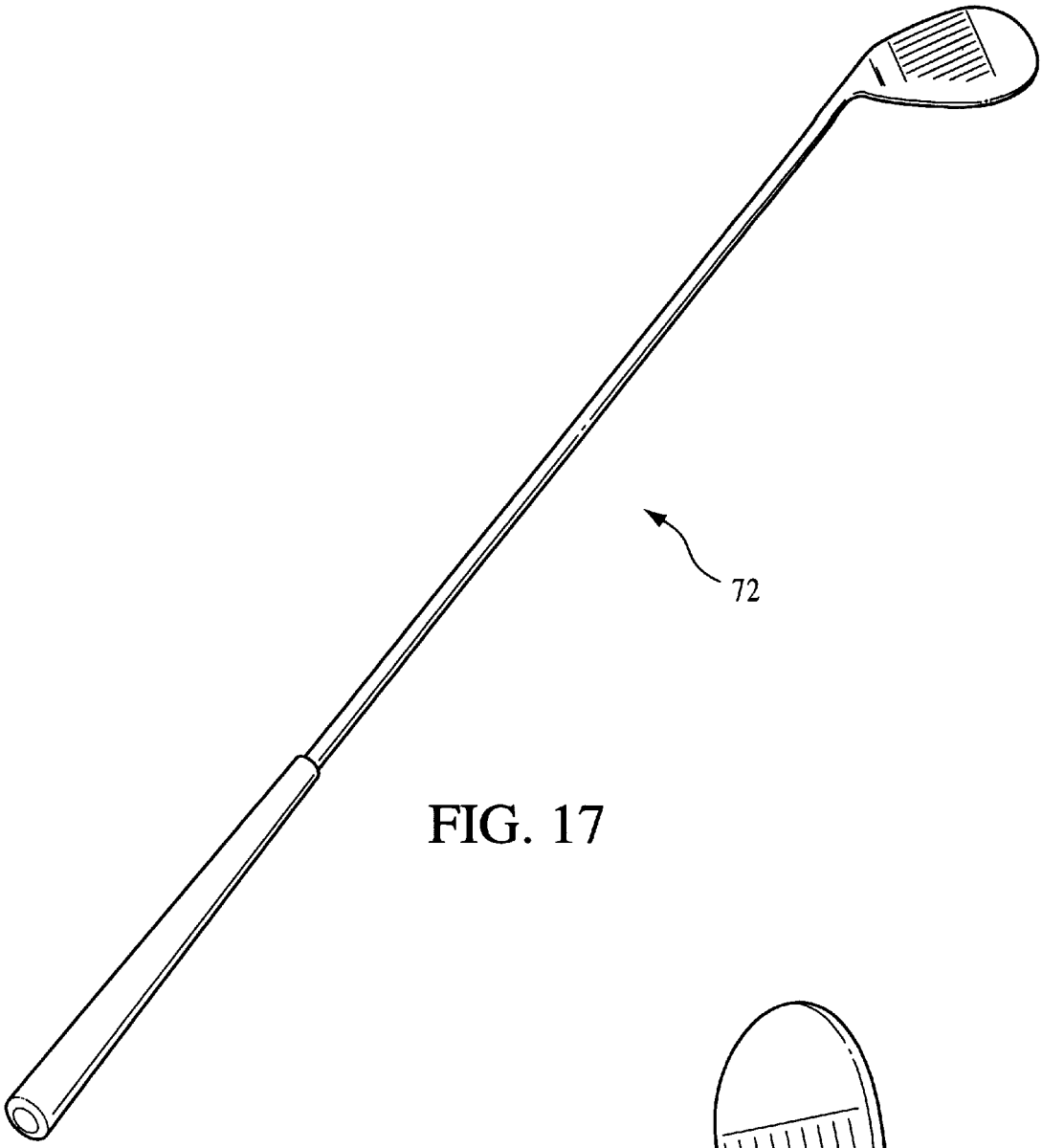
FIG. 17 is a longitudinal view of a club with a stiffening rod in accordance with a further embodiment of the present invention.
Figure 18:
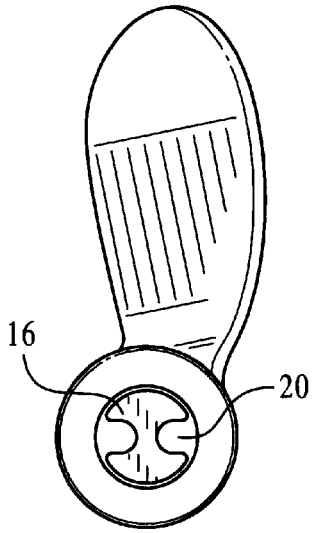
FIG. 18 is an end view thereof.
Figure 19:
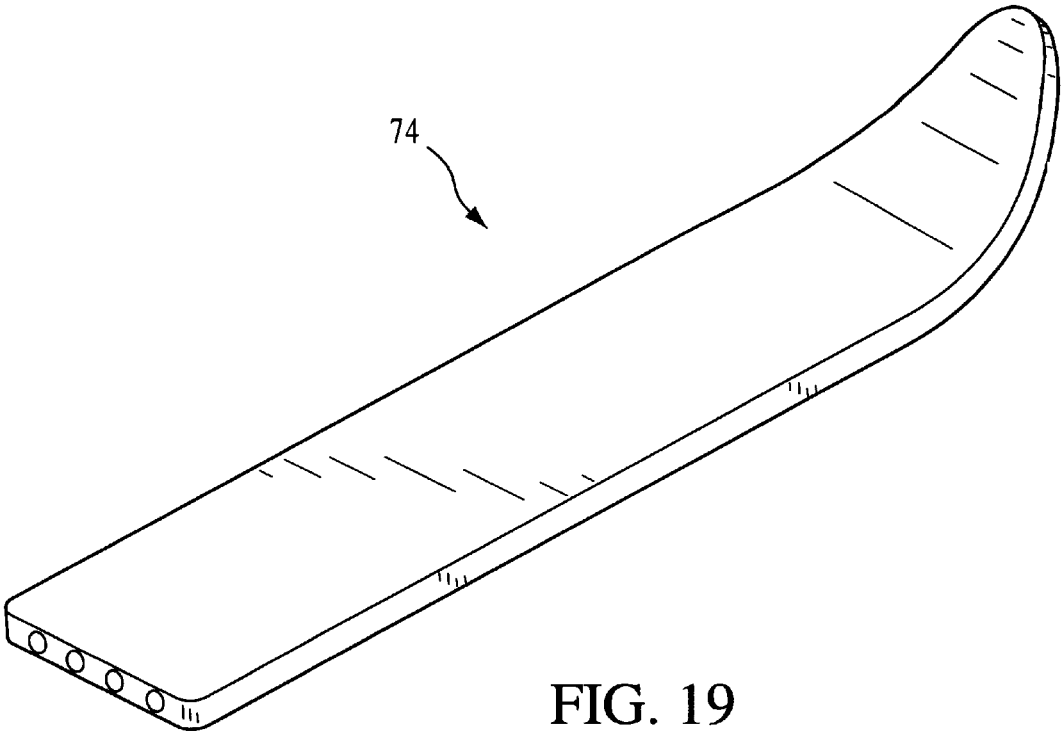
FIG. 19 is a longitudinal view of a ski with a stiffening rod in accordance with another embodiment of the present invention.
Figure 20:
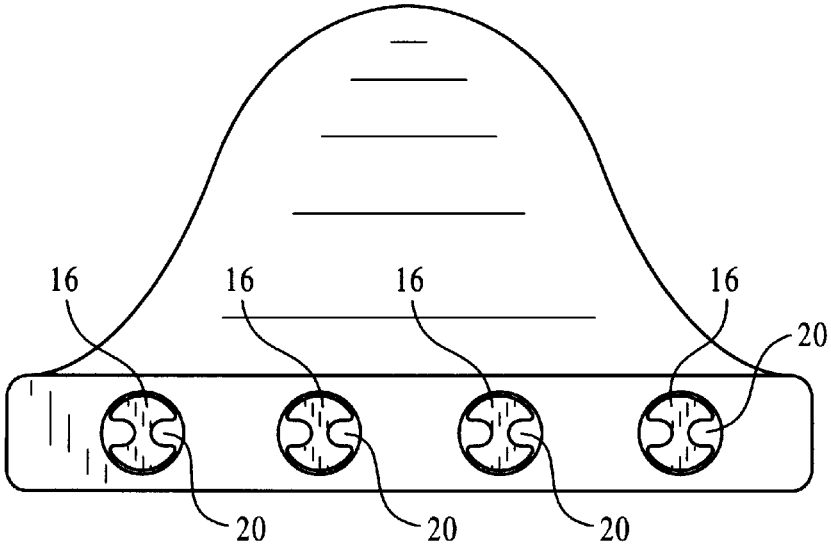
FIG. 20 is an end view thereof.
Figure 21:
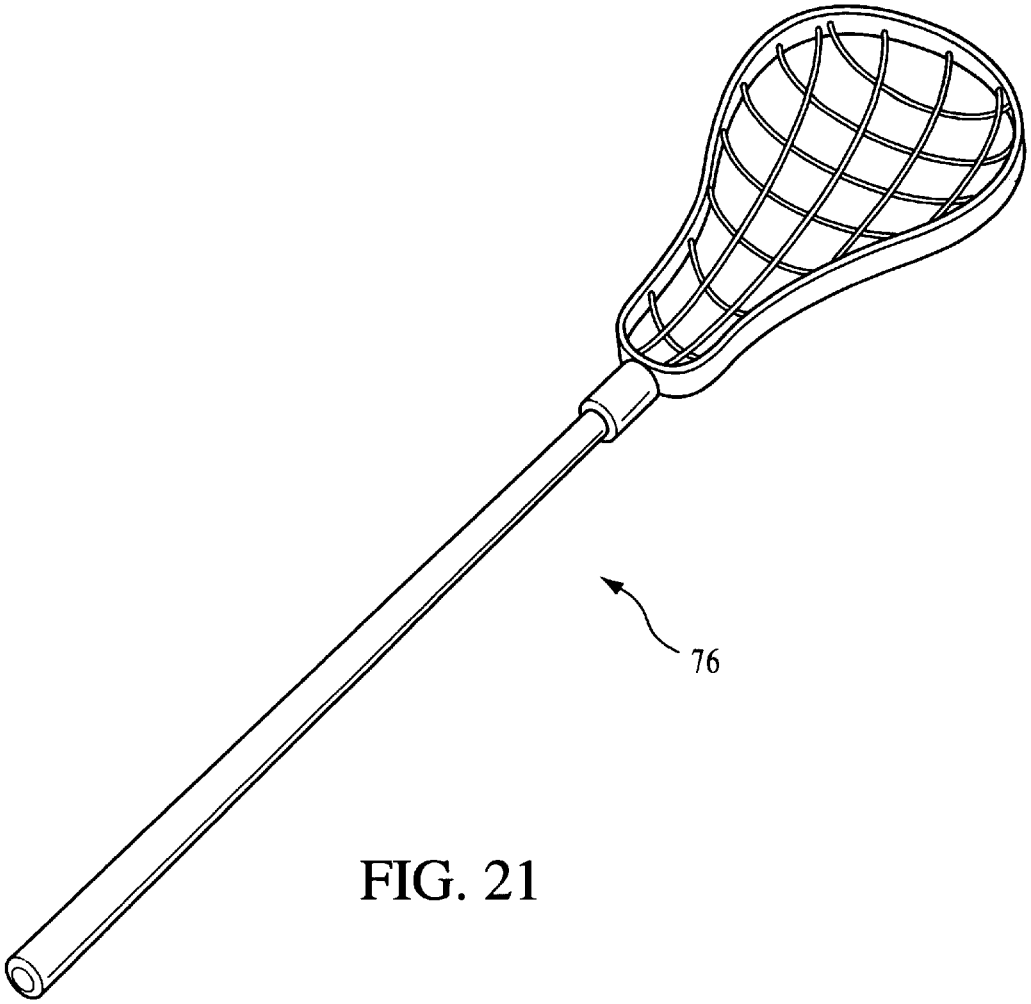
FIG. 21 is a longitudinal view of a lacrosse stick with a stiffening rod in accordance with yet an additional embodiment of the present invention.
Figure 22:
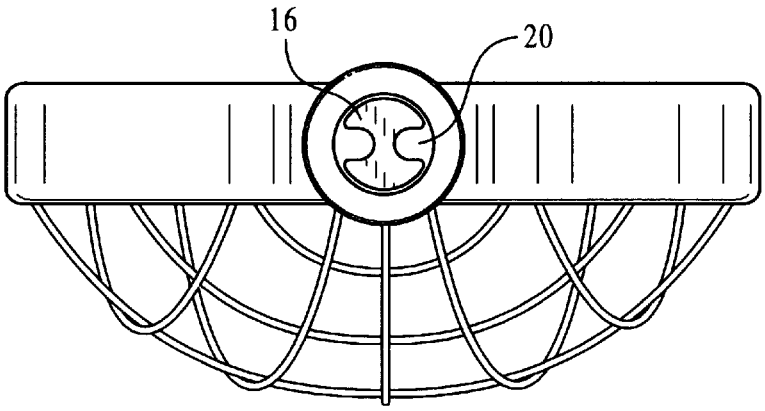
FIG. 22 is an end view thereof.
Figure 23:
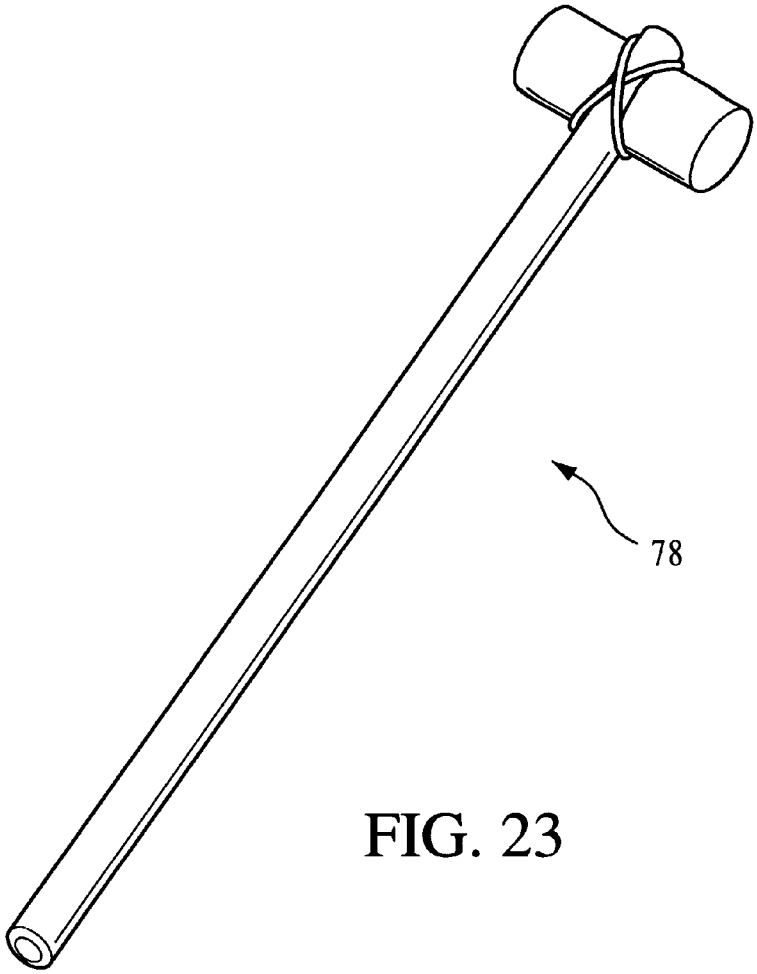
FIG. 23 is a longitudinal view of a mallet with a stiffening rod in accordance with yet a further embodiment of the present invention.
Figure 24:
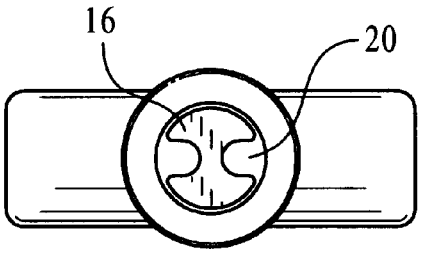
FIG. 24 is an end view thereof.
Figure 25:
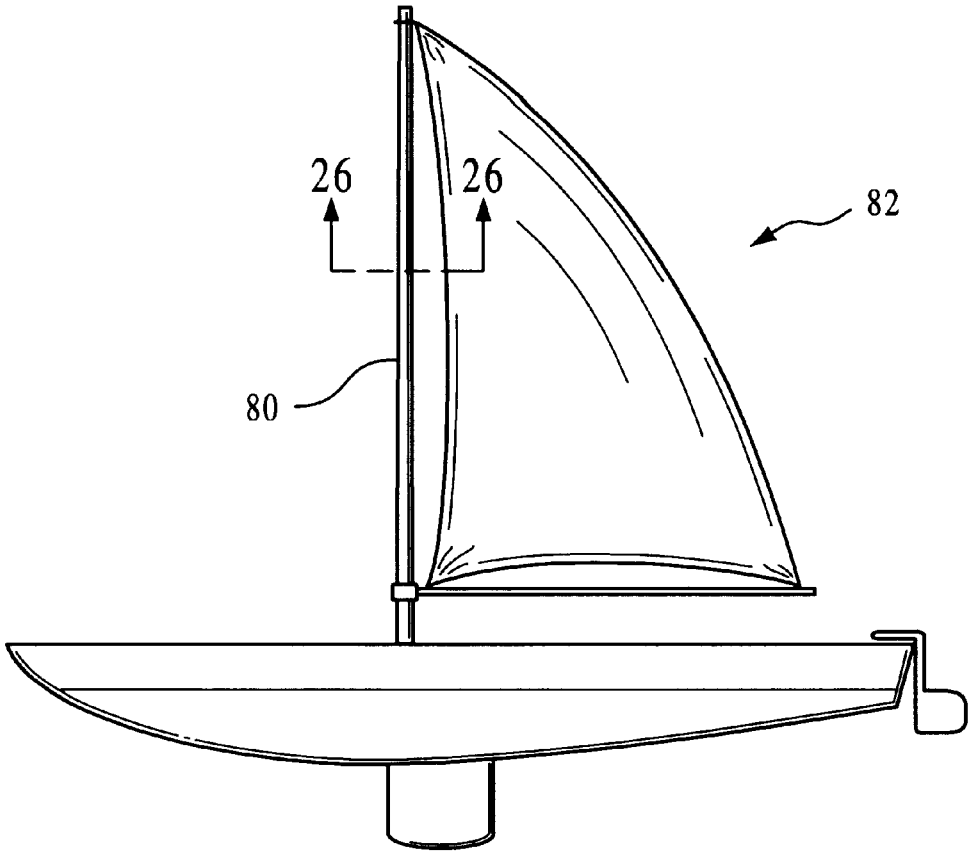
FIG. 25 is an elevation view of a sailboat with a mast having a stiffening rod in accordance with yet another embodiment of the invention.
Figure 26:
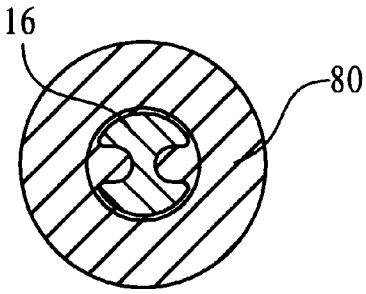
FIG. 26 is a cross-section across lines 26—26 of FIG. 25.
Figure 27:
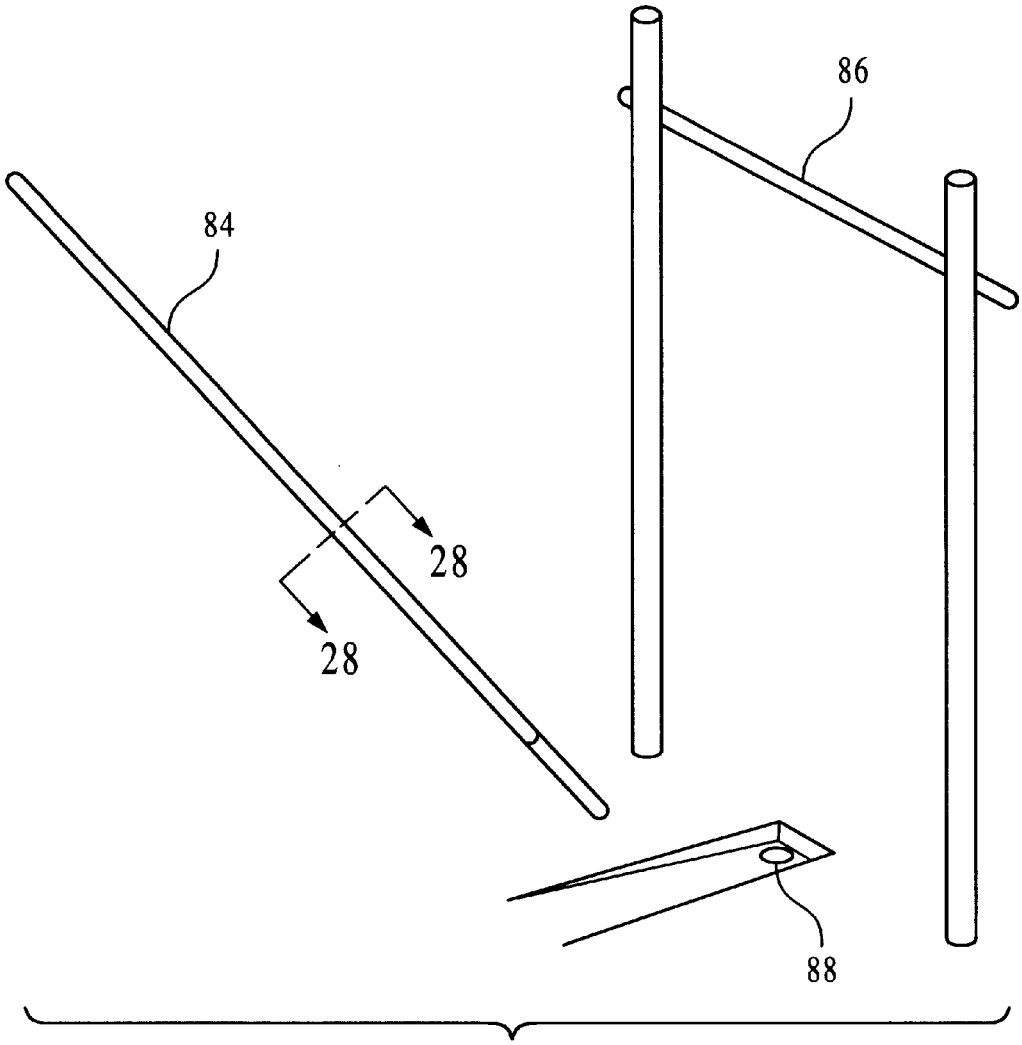
FIG. 27 is a perspective view of pole vault equipment including a pole having a stiffening rod in accordance with still an additional embodiment of the invention, shown in vicinity of a raised crossbar.
Figure 28:
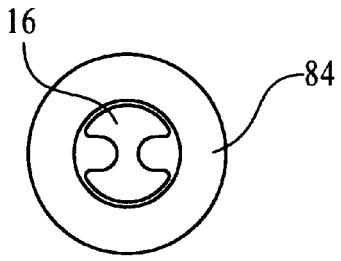
FIG. 28 is a cross-section across lines 28—28 of FIG. 27.

FIGS. 16–17 show the stiffening rod 16 in use in a tennis racket 70. FIGS. 17–18 show the stiffening rod 16 in use in a golf club 72. FIGS. 19–20 show the stiffening rod 16 in use in a ski 74. FIGS. 21–22 show the stiffening rod 16 in use in a lacrosse stick 76. FIGS. 23–24 show the stiffening rod 16 in use in a polo mallet 78. FIGS. 25–26 show the stiffening rod 16 in use in a mast 80 of a sailboat 82. FIGS. 27–28 show the stiffening rod 16 in use in a pole vault pole 84, with the raised crossbar 86 and receptacle 88 for the pole during the vault shown as well.

Figure 29:
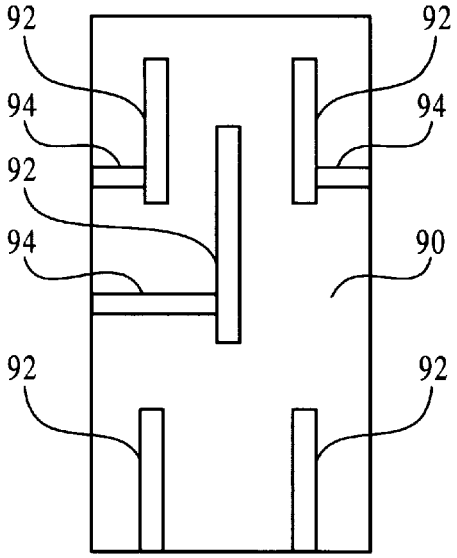
FIG. 29 is a schematic representation of a snow board showing locations for multiple stiffening rods in accordance with still a further embodiment.

FIG. 29 shows a snowboard 90 with multiple chambers 92 into which respective stiffening rods would be positioned. Access ports 94 are shown leading from to each of the chambers 92 and into which in inserted a complementary turning device that engages the stiffening rod to turn the same about a longitudinal axis relative to the stationary board.

In each case, the stiffening rod 16 fits within an elongated cavity 20 or chamber 92 as applicable, with the embodiment of FIGS. 19–20 and 29 showing the use of multiple cavities or chambers spaced across the ski or snow board to accommodate stiffening rods. Such is particular advantageous since adjustment of the stiffness or flexibility of the leading and trailing edges of the ski or snow board may be realized. That is, the leading edge may be made more stiff than the trailing edge or vice versa.

Thus each of these pieces of sports equipment as exemplified by the embodiments may be in a sense split up into multiple sections, each with its own adjustable flexibility and stiffness. The stiffening rods 16 may be stepped or tapered and need not be of uniform dimension.

While the cross-sectional shape of the stiffening rod 16 is common in each of the embodiments of FIGS. 16–22 with that used in the hockey stick of FIG. 1, the actual dimensions may vary depending upon the actual piece of sports equipment to which the stiffening rod is to be used. In all embodiments of FIGS. 1 and 16–22, it is preferred that the length of the stiffening rod reach a majority of the length of the stick shaft, racket handle, club shaft, ski or pole, a shorter length is also acceptable although the stiffening and flexibility results in certain directions will be less pronounced.

For the sake of brevity, the sports equipment such as a hockey stick or a lacrosse stick will be referred to as a stick; sports equipment such as a baseball bat, softball bat and cricket bat will be referred to as a bat; sports equipment such as a tennis racket, paddleball racket, squash racket, court tennis racket and badminton racket will be referred to as a racket; golf club will be referred to as a club; a water ski, a downhill ski and a cross-country ski will be referred to as a ski; a snow board or skiboard will be referred to as a board; a snow skate will be referred to as a skate; a pole vault pole and a ski pole will be referred to as a pole, an oar or paddle will be referred to collectively as a paddle, a polo mallet will be referred to as a mallet.

This list is not intended to be exhaustive; any other sports equipment that is not used to cast out a line or the like is included within the definition of sports equipment. What is common is that they flex either in response to striking or picking up and carrying an object or person or in response to environmental forces acting upon them such as the wind or in response to engaging frictional surfaces such as the ground, snow or water. Fishing rods do not fall under these categories and thus are excluded from the definition of sports equipment within the meaning of this application.

Figure 30:
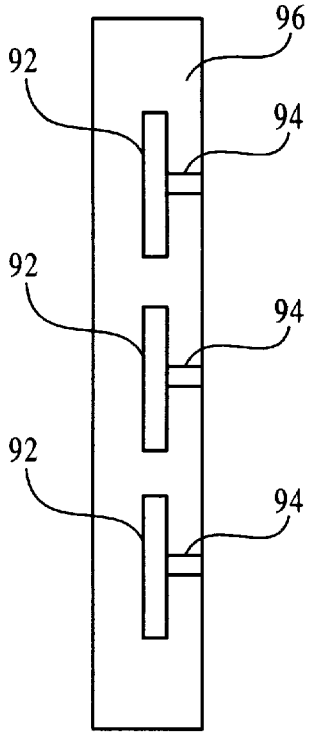
FIG. 30 is a schematic representation of elongated sports equipment showing the location of multiple stiffening rods in accordance with still another embodiment.

FIG. 30 shows an elongated sports equipment 96, such as the stick, bat, racket, club, ski, board, mast, pole, skate, paddle or mallet, having multiple chambers 92 into which respective stiffening rods would be positioned. Access ports 94 are also shown that serve the same purpose as that for the embodiment of FIG. 29.

FIGS. 29 and 30 further show the manner in which the flexibility or stiffness may be varied at different regions of the sports equipment independent of each other. The stiffening rods may be turned by providing access for turning at an end of the sports equipment or through access ports 94 that extend transverse to the direction of elongation of the stiffening rods.

Figure 31:
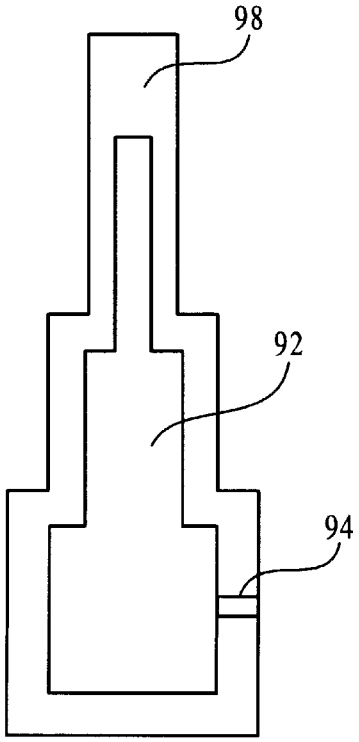
FIG. 31 is a schematic representation of sports equipment with stepped surfaces.
Figure 32:
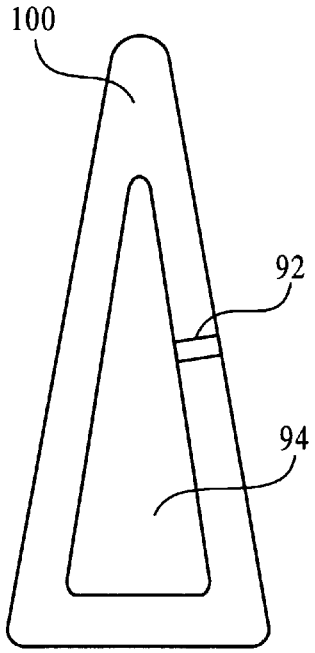
FIG. 32 is a schematic representation of sports equipment that tapers.

FIG. 31 shows sports equipment 98 that is stepped, with a cavity 92 stepped to receive a stiffening rod that is likewise stepped and conforms in shape to the cavity 92 of FIG. 31. FIG. 32 shows sports equipment 100 that is tapered with a cavity 92 tapered to receive a stiffening rod 16 that is likewise tapered and conforms in shape to the cavity 92 of FIG. 32. The access ports 94 permit access to rotate the stepped or tapered stiffening rods about their longitudinal axes.

The length of the cavity 20 in all embodiments must be dimensioned to fit the stiffening rod 16 within, but a small protruding portion is acceptable because the protruding portion will facilitate its removal from the cavity and may contain markings or indicia indicative of different degrees of stiffness or flexibility with respect to the stiffening rod's relative orientation within the cavity. A reference marking is provided at the end of the sports equipment neighboring where the stiffening rod 16 protrudes. The reference marking is arranged to signify the greatest stiffness or flexibility for a particular direction when an appropriate marking or indicia of the stiffening rod is turned to be coincident with the reference marking.

It is preferred that the stiffening rod 16 be rotatable within the cavity 20 under manual turning forces. If not, however, then the stiffening rod 16 may be removed from the cavity entirely, turned to the desired orientation and then inserted once more back into the cavity.

Preferably, the cavity is dimensioned so that the stiffening rod is friction fit therein. Otherwise, the technique depicted in FIGS. 4–10 may be employed to secure the stiffening rod to a cap or handle, which in turn is friction fit or otherwise secured to the stick shaft, racket handle, club shaft, pole, ski, paddle shaft or mallet shaft. In such a case, as long as the cap or handle remains in its position, the stiffening rod will remain in position and will not turn.

The actual configuration of the stiffening rod 16 may be changed to that of any of the embodiments of FIGS. 11–14 or any other desired configuration in which the stiffness in one direction is greater than in a different direction and the flexibility is greater in the different direction than the one direction, where both the one direction and the different direction are directed transverse to the longitudinal axis, in contrast to being coincident with it.

In each of the embodiments, the materials of the stiffening rod may be fabricated of any material having desired flexibility and stiffness characteristics. Such materials include, but are not limited to, metals, woods, rubber, thermoplastic polymers, thermoset polymers, ionomers, and the like.

The thermopolymers include the polyamide resins such as nylon; the polyolefins such as polyethylene, polypropylene, as well as their copolymers such as ethylene-propylene and EPDM; the polyesters such as polyethylene terephthalate and the like; vinyl chloride polymers and the like, and polycarbon resins. The thermoset resins include acrylic polymers, resole resins, epoxy polymers, and the like.

Polymeric materials may contain reinforcements that enhance the stiffness or flexure of the stiffening rod 16. Some reinforcements include fibers such as fiberglass, polymeric fibers, graphite fibers, carbon fibers, boron fibers and the like.

In addition, the protruding portion of the stiffening rod 16 may be freely accessible from the end of the piece of sports equipment or be enclosed by a suitable cap or handle end so that removal of this cap or handle would be necessary to gain access to the stiffening rod from the cavity and effect its removal. However, if the stiffening rod is freely turned within the cavity, then its removal would not be necessary to alter the direction of stiffness and flexibility if provision were made so that rotation of the cap or handle resulted in rotation of the stiffening rod.

Regardless of the sport, having the ability to change the flexibility and stiffness of the sports equipment affords an additional advantage in that it may be used as a training aid, allowing the player or teacher to instantly change only the flex and stiffness characteristics of the sports equipment, without altering the swing weight, grip size, feel, etc. This permits the focus of training to be only on the flex and not other factors.

Further, being able to change the flex or stiffness characteristics has real value for retail shops and pro shops where fitting of the sports equipment to suit the customer's needs is done. Thus, such shops are able to identify the sports equipment's flex that conforms to the customer's preference by adjusting the stiffness and flexibility of the present invention. Thereafter, an appropriate piece of sports equipment may be selected whose specific stiffness and flex characteristic matched that of the sports equipment flex identified with the present invention.

While the foregoing description and drawings represent the preferred embodiments of the present invention, it will be understood that various changes and modifications may be made without departing from the spirit and scope of the present invention.

What is claimed is:

1. A sports apparatus with variations in stiffness and flexibility, comprising:

sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis, the stiffening rod being arranged to turn about the longitudinal axis through a plurality of relative positions and accommodated by the cavity in any one of the plurality of relative positions, the sports equipment being configured into any one of a hockey stick and a golf club, the hockey stick having a hollow shaft as the body and having a blade projecting from an end of the hollow shaft in a direction different from the direction that the hollow shaft extends, the golf club having a club shaft as the body and having a club head that extends from an end of the club shaft and extending in a direction different from the direction that the club shaft extends and being wider than a diameter of the club shaft.

2. An apparatus as in claim 1, wherein the stiffening rod has a transverse cross-section configured as an I-shape.

3. An apparatus as in claim 1, wherein the stiffening rod has a transverse cross-section configured to have at least two oval gaps spaced apart from each other within confines of a periphery of the stiffening rod.

4. An apparatus as in claim 1, wherein the stiffening rod has a transverse cross-section configured with an oval core and spikes extending radially from the oval core.

5. An apparatus as in claim 4, wherein the spikes form a series of M-shapes.

6. An apparatus as in claim 1, wherein the stiffening rod has a transverse cross-section configured to have at least two rectangular gaps spaced apart from each other within confines of a periphery of the stiffening rod.

7. An apparatus as in claim 1, wherein the stiffening rod has a transverse cross-section configured with a first series of holes and a second series of holes, the first series of holes aligned with each other and having a total number of holes that exceeds that of the second series of holes, the second series of holes being aligned with each other and out of alignment with that of the first series of holes.

8. An apparatus as in claim 1, wherein outwardly facing sides of the I-shape are convex.

9. An apparatus as in claim 1, wherein the cavity is circular in transverse cross-section.

10. An apparatus as in claim 1, wherein the cavity is rectangular in transverse cross-section.

11. An apparatus as in claim 1, wherein the stiffening rod is extruded plastic.

12. An apparatus as in claim 1, wherein the stiffening rod has a dimension from the longitudinal axis to an outermost periphery, the cavity having a transverse area at least as wide as the dimension to permit the stiffening rod to turn about the longitudinal axis in any one of a plurality of relative positions within the cavity.

13. An apparatus as in claim 1, further comprising a handle and a fastener securing the handle to the stiffening rod, the stiffening rod being rotatable in unison with the handle in response to rotation of the handle.

14. An apparatus as in claim 1, wherein the stiffening rod contains a reinforcement bar of a material having a greater strength than that of a remainder of the stiffening rod.

15. An apparatus as in claim 1, wherein the stiffening rod is any one of tapered and stepped.

16. A sports apparatus with variations in stiffness and flexibility, comprising:

sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction both the one direction and the different direction being directed transverse to the longitudinal axis the stiffening rod having a portion protruding out of the cavity, further comprising a cap secured to the portion of the stiffening rod protruding out of the cavity.

17. An apparatus as in claim 16, wherein the cap includes a holder, a fastener, and a sheath, the sheath enclosing the holder and having an opening, the fastener being connected to the holder through the opening and being tightened to secure the portion of the stiffening rod protruding out of the cavity to the holder so that turning the fastener about the longitudinal axis of the stiffening rod causes the stiffening rod to rotate within the cavity.

18. A sports apparatus with variations in stiffness and flexibility, comprising:

sports equipment having a body with an elongated cavity;

a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis; and an indicator attached to the rod, the indicator having markings arranged in a manner indicative of different degrees of stiffness or flexibility with respect to a relative orientation of the stiffness rod within the cavity.

19. An apparatus as in claim 18, further comprising designation on the body that, when aligned with one of the markings of the indicator, signifies a setting of the stiffening rod corresponding to a degree of stiffness associated with the one of the markings.

20. A sports apparatus with variations in stiffness and flexibility, comprising:

sports equipment having a body with an elongated cavity;

a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis; and at least one further elongated cavity in the body and at least one further stiffening rod within the further elongated cavity, the further stiffening rod being inserted within the further elongated cavity and being stiffer in a given direction than in another direction, both the given and another directions being transverse to a direction of elongation of the further stiffening rod, an indicator attached to the body, the indicator having markings arranged in a manner indicative of different degrees of stiffness or flexibility with respect to a relative orientation of the first-mentioned stiffening rod within the first-mentioned cavity, and a further indicator attached to the body, the further indicator having markings arranged in a manner indicative of different degrees of stiffness or flexibility with respect to a relative orientation of the further stiffening rod within the further cavity.

21. A sports apparatus with variations in stiffness and flexibility, comprising:

sports equipment having a body with an elongated cavity through which extends a longitudinal axis in a direction of elongation of the cavity; and an element imparting stiffness and flexibility variations within the cavity so the sports equipment becomes more stiff in one direction than in a different direction and is more flexible in the different direction than in the one direction, both the one direction and the different direction being directed transverse to the longitudinal axis, the element being configured to turn about the longitudinal axis through a plurality of relative positions and accommodated by the cavity in any one of the plurality of relative positions, the sports equipment being configured into any one of a hockey stick and a golf club, the hockey stick having a hollow shaft as the body and having a blade projecting from an end of the hollow shaft in a direction different from the direction that the hollow shaft extends, the golf club having a club shaft as the body and having a club head that extends from an end of the club shaft and extending in a direction different from the direction that the club shaft extends and being wider than a diameter of the club shaft.

22. An apparatus as in claim 21, wherein the element is a stiffening rod that is elongated and fits within the cavity.

23. An apparatus as in claim 21, further comprising a handle and a fastener that fastens the handle to the stiffening rod, the stiffening rod being rotatable in unison with the handle in response to rotation of the handle.

24. An apparatus as in claim 21, wherein the element contains a reinforcement bar of a material having a greater strength than that of a remainder of the element.

25. An apparatus as in claim 21, wherein the stiffening rod is any one of tapered and stepped.

26. A sports apparatus with variations in stiffness and flexibility, comprising:

sports equipment having a body with an elongated cavity through which extends a longitudinal axis in a direction of elongation of the cavity;

an element imparting stiffness and flexibility variations within the cavity so the sports equipment becomes more stiff in one direction than in a different direction and is more flexible in the different direction than in the one direction, both the one direction and the different direction being directed transverse to the longitudinal axis, the element being a stiffening rod that is elongated and fits within the cavity; and an indicator of a degree of stiffness or flexibility with respect to a relative orientation of the stiffening rod within the cavity, the indicator being arranged on at least one of the body and the stiffening rod.

27. A sports apparatus with variations in stiffness and flexibility, comprising:

sports equipment having a body with an elongated cavity through which extends a longitudinal axis in a direction of elongation of the cavity;

an element imparting stiffness and flexibility variations within the cavity so the sports equipment becomes more stiff in one direction than in a different direction and is more flexible in the different direction than in the one direction, both the one direction and the different direction being directed transverse to the longitudinal axis; and at least one further elongated cavity in the body and at least one further element within the further elongated cavity, the further element being stiffer in a given direction than in another direction, both the given and another directions being transverse to a direction of elongation of the further element, an indicator attached to the element and a further indicator attached to the further element, the first-mentioned indicator having markings arranged in a manner indicative of different degrees of stiffness or flexibility with respect to a relative orientation of the first-mentioned element within the first-mentioned cavity, the further indicator having markings arranged in a manner indicative of different degrees with stiffness or flexibility with respect to a relative orientation of the further element within the further cavity.

28. A sports apparatus with variations in stiffness and flexibility, comprising:

sports equipment having a body with an elongated cavity;

a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis; and an indicator attached to the body, the indicator having markings arranged in a manner indicative of different degrees of stiffness or flexibility with respect to a relative orientation of the stiffening rod within the cavity.

29. A sports apparatus with variations in stiffness and flexibility, comprising:

sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis, the stiffening rod being arranged to turn about the longitudinal axis through a plurality of relative positions and accommodated by the cavity in any one of the plurality of relative positions, the sports equipment being configured into any one of a hockey stick and a golf club, the hockey stick having a hollow shaft as the body and having a blade projecting from an end of the hollow shaft in a direction different from the direction that the hollow shaft extends, the golf club having a club shaft as the body and having a club head that extends from an end of the club shaft and extending in a direction different from the direction that the club shaft extends and being wider than a diameter of the club shaft;

at least one further elongated cavity in the sports equipment and at least one further stiffening rod with the further elongated cavity, the further stiffening rod being inserted within the further elongated cavity and being stiffer in a given direction than in another direction, both the given and another directions being transverse to a direction of elongation of the further stiffening rod; and an indicator attached to the first-mentioned stiffening rod and a further indicator attached to the further stiffening rod, the first-mentioned indicator having markings arranged in a manner indicative of different degrees of stiffness or flexibility with respect to a relative orientation of the first-mentioned stiffening rod within the first-mentioned cavity, the further indicator having markings arranged in a manner indicative of different degrees of stiffness or flexibility with respect to a relative orientation of the further stiffening rod within the further cavity.

30. A sports apparatus with variations in stiffness and flexibility, comprising:

sports equipment having a body with an elongated cavity; and a stiffening rod that is elongated and has a longitudinal axis in a direction of elongation of the stiffening rod, the stiffening rod being inserted within the cavity and stiffer in one direction than in a different direction and being more flexible in the different direction than in the one direction, both the one direction and the different direction being directed transverse to the longitudinal axis, the stiffening rod being arranged to turn about the longitudinal axis through a plurality of relative positions and accommodated by the cavity in any one of the plurality of relative positions, the sports equipment being configured into any one of a hockey stick and a golf club, the hockey stick having a hollow shaft as the body and having a blade projecting from an end of the hollow shaft in a direction different from the direction that the hollow shaft extends, the golf club having a club shaft as the body and having a club head that extends from an end of the club shaft and extending in a direction different from the direction that the club shaft extends and being wider than a diameter of the club shaft;

further comprising an indicator attached to the body, the indicator having markings arranged in a manner indicative of different degrees of stiffness or flexibility with respect to a relative orientation of the first-mentioned stiffening rod within the first-mentioned cavity, and a further indicator attached to the body, the further indicator having markings arranged in a manner indicative of different degrees of stiffness or flexibility with respect to a relative orientation of the further stiffening rod within the further cavity.

31. A method of varying stiffness and flexibility, comprising:

providing sports equipment having a body with an elongated cavity through which extends a longitudinal axis in a direction of elongation of the cavity; and imparting stiffness and flexibility variations by turning stiffening rod within the cavity so the sports equipment becomes more stiff in one direction than in a different direction and is more flexible in the different direction than in the one direction, both the one direction and the different direction being directed transverse to the longitudinal axis, the stiffening rod being turned about the longitudinal axis through a plurality of relative positions and accommodated by the cavity in any one of the plurality of relative positions, the sports equipment being configured into any one of a hockey stick and a golf club, the hockey stick having a hollow shaft as the body and having a blade projecting from an end of the hollow shaft in a direction different from the direction that the hollow shaft extends, the golf club having a club shaft as the body and having a club head that extends from an end of the club shaft and extending in a direction different from the direction that the club shaft extends and being wider than a diameter of the club shaft.

32. A method as in claim 26, wherein the imparting includes inserting into the cavity a stiffening rod that is elongated and fits within the cavity.

33. A method as in claim 32, further comprising securing a handle to the stiffening rod, and rotating the stiffening rod in unison with the handle in response to rotating the handle.

34. A method of varying stiffness and flexibility, comprising:

providing sports equipment having a body with an elongated cavity through which extends a longitudinal axis in a direction of elongation of the cavity;

imparting stiffness and flexibility variation within the cavity by inserting into the cavity a stiffening rod that is elongated and fits within the cavity so the sports equipment becomes more stiff in one direction than in a different direction and is more flexible in the different direction than in the one direction, both the one direction and the different direction being directed transverse to the longitudinal axis, the stiffening rod being turned about the longitudinal axis through a plurality of relative positions and accommodated by the cavity in any one of the plurality of relative positions; and marking a degree of stiffness or flexibility of the stiffening rod relative to an orientation of the stiffening rod within the cavity.

35. A method of varying stiffness and flexibility, comprising:

providing sports equipment having a body with an elongated cavity through which extends a longitudinal axis in a direction of elongation of the cavity;

imparting stiffness and flexibility variation within the cavity by inserting into the cavity a stiffening rod that is elongated and fits within the cavity so the sports equipment becomes more stiff in one direction than in a different direction and is more flexible in the different direction than in the one direction, both the one direction and the different direction being directed transverse to the longitudinal axis, the stiffening rod being turned about the longitudinal axis through a plurality of relative positions and accommodated by the cavity in any one of the plurality of relative positions; and indicating a degree of stiffness or flexibility of the stiffening rod relative to an orientation of the stiffening rod within the cavity.

* * * * *